United States Patent [19]

Kutsuna et al.

[11] Patent Number: 4,520,045

[45] Date of Patent: May 28, 1985

[54] METHOD FOR IMPREGNATING A DIE-CAST ARTICLE WITH A SEALANT AND AN IMPREGNATION APPARATUS THEREFOR

[75] Inventors: Tomoharu Kutsuna, Toyota; Shinzi Ohtani, Okazaki; Kunimasa Kondo, Nagoya, all of Japan

[73] Assignees: Taiho Kogyo Co., Ltd.; Yugenkaisha Hakusui Sangyo, both of Aichi, Japan

[21] Appl. No.: 563,342

[22] Filed: Dec. 20, 1983

[30] Foreign Application Priority Data

Feb. 15, 1983 [JP] Japan ..... 58-22068
Apr. 14, 1983 [JP] Japan ..... 58-65885

[51] Int. Cl.[3] ..... B05D 3/00; C23C 13/08

[52] U.S. Cl. ..... 427/294; 118/50; 427/295

[58] Field of Search ..... 427/294, 295; 118/50

[56] References Cited

U.S. PATENT DOCUMENTS 4,311,735 1/1982 Young ..... 118/50 X
4,384,014 5/1983 Young ..... 427/294

*Primary Examiner*—Michael R. Lusignan
*Attorney, Agent, or Firm*—Armstrong, Nikaido, Marmelstein & Kubovcik

[57] ABSTRACT

In a conventional method of impregnating die-cast articles, the sealing property is not excellent due to air being dragged into the sealant.

In the present invention, the dragging of air into the sealant is prevented by adjusting the pressure of the sealant storage vessel and the pressure of the impregnation vessel to substantially the same level and then flowing the sealant from the sealant storage vessel into the impregnation vessel. After impregnation, the sealant reenters the sealant storage vessel, and pressure is applied to the die-cast articles so as to remove excessive sealant from them.

18 Claims, 3 Drawing Figures

METHOD FOR IMPREGNATING A DIE-CAST ARTICLE WITH A SEALANT AND AN IMPREGNATION APPARATUS THEREFOR

BACKGROUND OF THE INVENTION

1. Field of the invention

The present invention relates to a method for impregnating a die-cast article with a sealant and an impregnation apparatus for implementing this method. More particularly, the present invention relates to an improved impregnation method and apparatus in which the sealing property and sealing yield are enhanced.

2. Description of the Prior Art

Die-cast articles inevitably include cast defects. When die-cast articles are to be used as pressure-proof and gas-tight articles, such as housings of swash plate-type compressors, their cast defects, which are acceptable if they are used as nonpressure-proof and/or non-gas-tight articles, must be sealed since the pressure leaks through the cast defects. In order to seal the cast pores of die-cast articles, the cast pores are impregnated with a sealant.

The sealant includes inorganic material, such as water glass, and organic material, such as a resin. Acrylic resin is frequently used as a resin since it has a good sealing property and is inexpensive. "Sealing property" herein means the ability of a sealant to gas-tightly seal the cast defects, which, in general, are very minute. In order to test the sealing property of a swash plate-type compressor housing made of a die-cast article, a pressure of 45 $kg/cm^2$ (441 MPa) is applied to the housing, previously subjected to sealant impregnation. If pressure leakage occurs, the sealing property is unacceptable. This test method is carried out under very severe conditions since a swash plate-type compressor housing must have a considerably strict pressure-proofness and air tightness.

A prior art is explained with reference to FIG. 1.

In FIG. 1, a workpiece (not shown) is placed within an impregnation vessel 1 and then the inner space of the impregnation vessel 1 is evacuated to create a vacuum. A sealant storage vessel 2, which is open to the ambient air, is communicated with the impregnation vessel 1 via a channel equipped with valves 3. The valves 3 are opened so that the sealant flows from the sealant storage vessel 2 into the impregnation vessel 1. Subsequently, the valves 3 are closed, and the pressure within the impregnation vessel 2 is enhanced so as to impregnate the workpiece with the sealant. Then the valves 3 are again opened so that the sealant reflows from the impregnation vessel 1 into the sealant storage vessel 2. The impregnation vessel 1 is opened to the ambient air and the impregnated workpiece is withdrawn from the impregnation vessel 1 and is subsequently washed and heated to harden or dry the sealant. The prior art described with reference to FIG. 1 cannot attain a high sealing property which is desired for a pressure-proof and gas-tight article bacause during the flow of the sealant from the sealant storage vessel 2 into the impregnation vessel, air is dragged into the sealant and bubbles are formed.

More in detail, since the sealant storage vessel 2 is opened to the ambient air and the pressure in the impregnation vessel 1 is adjusted to low to degas the air contained in the cast defects of the workpiece, a great pressure difference is created between the two vessels when the sealant starts to flow from the sealant storage vessel 2 into the impregnation vessel 1. The sealant flow is, therefore, vigorous in a turbulent flow which drags air thereinto, causing bubbles to form.

According to another prior art, a workpiece is placed in a pressure kettle and the pressure of the kettle inner space is decreased to a vacuum so as to degas the air from the cast defects of the workpiece. Then the workpiece is subjected to sealant impregnation to fill the degassed cast defects with a resin sealant. Next, the workpiece is subjected to hydroextraction and then is rinsed with cold water so as to remove the excessive resin sealant which covers the workpiece in a film form. Finally, polymerization of the resin is carried out in boiling water. In this prior art, the fraction defective, which is unacceptable in pressure-proof and gas-tight articles, is disadvantageously high because the degassing is not satisfactory. In addition, the excessive resin sealant which is recovered during hydroextraction is returned to and reused in the sealant impregnation step. However, sealant recovery is not very high. This is because during hydroextraction the resin sealant is not entirely removed but is removed to such an extent that it falls down as droplets. Therefore, the resin sealant which remains in holes or recesses of an intricate workpiece cannot be hydroextracted. The resin sealant which is not hydroextracted is rinsed and becomes waste since it is difficult to separate the resin sealant from water. In the described prior art, one part of the resin sealant is used to impregnate a workpiece while ten or more parts of the resin sealant are not recovered and thus are not reused, with the result that impregnation recovery is low.

According to another prior art, in which an inorganic material is mainly used as a sealant, a workpiece is placed in an impregnation vessel, the pressure of the impregnation vessel is decreased, the sealant is poured into the impregnation vessel, and compressed air pressure is applied to the surface of a sealant bath so as to impregnate the workpiece with the sealant under pressure. The sealant is then returned to a reservoir vessel, and the pressure of the impregnation vessel is reverted to normal. Next, the workpiece is transferred from the impregnation vessel to a rinsing vessel, in which the workpiece is rinsed with water which is stirred with compressed air. This prior art also involves disadvantages resulting from air being dragged into the sealant.

SUMMARY OF THE INVENTION

It is an object of the present invention to provide an improved method for impregnating a die-cast article with a sealant, thereby enhancing the sealing property and thus lessening the pressure leakage of a die-cast article as compared with the prior arts.

It is another object of the present invention to enhance the impregnation recovery of a sealant.

It is a further object of the present invention to provide an improved impregnation apparatus in which an impregnated die-cast article is provided with an excellent sealing property and in which the sealant can be recovered satisfactorily.

In accordance with the objects of the present invention, there is provided a method for impregnating a die-cast article with a sealant, comprising the steps of:

preparing an impregnation vessel equipped with a first means for controlling the pressure therein, the means including a conduit and a pump;

preparing a sealant storage vessel equipped with a second means for controlling the pressure therein and being communicated with the impregnation vessel via a channel equipped with a valve;

locating the die-cast article within the impregnation vessel;

admitting the sealant into the sealant storage vessel while closing the valve of the channel;

operating the first pressure-controlling means so as to evacuate the air contained in the impregnation vessel and so as to degas the air contained in the cast defects of the die-cast article while the valve of the channel is closed;

operating the second pressure-controlling means so as to evacuate the air contained in the sealant storage vessel into which the sealant is admitted while the valve of the channel is closed;

while the valve of the channel is closed, operating at least one of the first and second pressure-controlling means so as to adjust the pressure in the impregnation vessel and the pressure in the sealant storage vessel to substantially the same level;

opening the valve, thereby causing the sealant to flow from the sealant storage vessel and the impregnation vessel through the channel;

closing the valve of the channel so as to stop the flow of the sealant when the die-cast article is immersed in the sealant;

impregnating the sealant into the die-cast body;

creating a pressure difference between the sealant storage vessel and the impregnation vessel, the pressure difference being created, after the above mentioned valve opening step and, at the latest, before completion of the subsequent valve-opening and reflowing step; and opening the valve of the channel and reflowing the sealant from the impregnation vessel into the sealant storage vessel through the channel, the reflowing being carried out essentially due to the pressure difference.

A preferable method for impregnating a die-cast article with a sealant, according to the present invention, comprises the steps of:

preparing an impregnation vessel equipped with a first means for controlling the pressure therein, the means including a conduit and a pump;

preparing a sealant storage vessel equipped with a second means for controlling the pressure therein and being communicated with the impregnation vessel via a channel equipped with a valve;

locating the die-cast article within the impregnation vessel;

admitting the sealant into the sealant storage vessel while closing the valve of the channel;

operating the first pressure-controlling means so as to evacuate the air contained in the impregnation vessel and so as to degas the air contained in the cast defects of the die-cast article while the valve of the channel is closed;

operating the second pressure-controlling means so as to evacuate the air contained in the sealant storage vessel into which the sealant is admitted while the valve of the channel is closed;

while the valve is closed, operating at least one of the first and second pressure-controlling means so as to adjust the pressure in the impregnation vessel and the pressure in the sealant storage vessel to substantially the same level;

opening the valve of the channel, thereby causing the sealant to flow from the sealant storage vessel into the impregnation vessel through the channel;

closing the valve of the channel so as to stop the flow of the sealant when the die-cast article is immersed in the sealant;

impregnating the die-cast article with the sealant and applying pressure to the sealant simultaneous with the impregnating step, thereby creating a pressure difference between the sealant storage vessel and the impregnation vessel; and opening the valve of the channel and reflowing the sealant from the impregnation vessel into the sealant storage vessel through the channel.

An apparatus for impregnating a die-cast article with a sealant according to the present invention comprises:

a gas- and liquid-tight impregnation vessel equipped with a first means for controlling the pressure therein, the means including a conduit and a pump; and a gas- and liquid-tight sealant storage vessel equipped with a second means for controlling the pressure therein and being communicated with the impregnation vessel via a channel equipped with a closable valve.

According to the present invention, since the sealant flows from the sealant storage vessel into the impregnation vessel while the pressures of these two vessels are kept substantially the same, no dragging in of air, and thus no bubble formation, takes place during the flow of the sealant. Therefore, the sealing property according to the present invention is excellent. That is, the filling of the cast defects with the sealant is not impeded by air bubbles, and, also, air cannot reenter into the degassed cast defects.

An apparatus according to the present invention may further comprise a means for detecting the sealant level in the sealant storage vessel, the means being operably connected to the closable valve and being positioned in the sealant storage vessel in such a manner that it can detect the sealant level when a substantial amount of the sealant is caused to flow into the impregnation vessel.

BRIEF DESCRIPTION OF THE DRAWINGS

The present invention is described hereinafter with reference to FIGS. 2 and 3.

Referring to FIG. 2, an impregnation vessel 5 is gas- and liquid-tight and includes workpieces 8, i.e., die-cast articles to be impregnated.

In FIG. 2, only one impregnation vessel 5 is shown, but two impregnation vessels may be used to enhance the impregnation efficiency. The cover (not shown) of the impregnation vessel 5 is disassembled, and the workpieces 8 are located on a grid (not shown) or any other support. The impregnation vessel 5 is then closed with the cover so as to maintain the gas and liquid tightness of the impregnation vessel 5.

Figure 1:
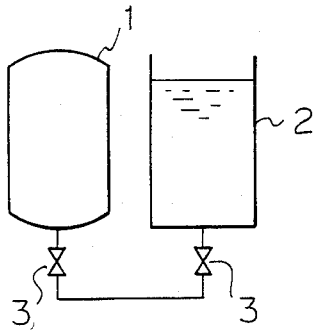
FIG. 1 is a schematic drawing of an impregnation apparatus according to a prior art.

A sealant storage vessel 6 contains a predetermined amount of the sealant 7 and is communicated with the impregnation vessel 5 via a channel 10 equipped with a valve 9. When the sealant 7 is admitted into the sealant storage vessel 6, the valve 9 must be closed.

The impregnation vessel 5 is equipped with a conduit 15, a valve 17, a vacuum pump 12, a valve 16, a pressure pump 13, a valve 21, and a conduit 22, which are first means for controlling the pressure in the impregnation vessel 5. The valves 16, 17, and 21 are closed when the sealant 7 is admitted into the sealant storage vessel 6.

The valve 17 is opened and the vacuum pump 12 is actuated so as to degas the air contained in the cast defects of the workpieces 8 while closing the valve 9. After degassing, the pressure within the impregnation vessel 5 is decreased from atmospheric pressure to a vacuum of preferably 5 mbar (500 Pa).

The sealant storage vessel 6 is equipped with a conduit 14, a valve 18, and the vacuum pump 12, i.e., the second pressure-controlling means. The vacuum pump 12 is commonly used by the first pressure-controlling means and the second pressure-controlling means. The first and second pressure-controlling means may have separate vacuum pumps but preferably have a common vacuum pump in the light of investment costs. While the valve 19 (described later) and the valve 9 are closed, the valve 18 is opened so as to communicate the inner space of the sealant storage vessel 6 with the vacuum pump 12. The vacuum pump 12 is activated so as to evacuate the air contained in the sealant storage vessel 6. The vacuum pump 12 may be activated once or twice. If the vacuum pump 12 is activated only once, the valves 17 and 18 are opened and the impregnation vessel 5 and the sealant storage vessel 6 are simultaneously evacuated.

The degree of vacuum in the impregnation vessel 5 depends on the sealing property desired and is usually 5 mbar (500 Pa) or less, preferably 3 mbar (300 Pa) or less. After attaining the predetermined degree of vacuum, the workpieces 8 are desirably exposed to the vacuum over a period ranging from 10 minutes to 15 minutes.

As a result of evacuation of the air of the two vessels 5 and 6, the pressure of these two vessels 5 and 6 is substantially equal. The smaller the pressure difference between the two vessels 5 and 6 is, the calmer the flow of the sealant is.

The valve 9 is opened, thereby causing the sealant 7 to flow from the sealant storage vessel 6 into the impregnation vessel 5. This flow is a calm flow and a laminate flow because the pressure of the vessels 5 and 6 is substantially equal. The pressure in the impregnation vessel 5 is substantially the same as that in the sealant storage vessel 6.

In order to attain a very calm flow of the sealant, the impregnation vessel 5 and the sealant-storage vessel 6 should be installed at substantially the same level. However, slight difference in the levels at which the vessels 5 and 6 are installed does not impede the calm flow of the sealant.

If it is necessary to transfer the entire volume of the sealant 7 from the sealant storage vessel 6 to the impregnation vessel 5 and, during this transfer, some of the sealant 7 remains in the sealant storage vessel 6, atmospheric pressure may be applied to the surface level of the sealant 7 to achieve the transfer thereof. This atmospheric pressure application is initiated when a substantial volume of the sealant 7 has been transferred to the impregnation vessel 5, and, thus, the sealant levels of the two vessels 5 and 6 become substantially equal. Atmospheric pressure application should be slowly carried out, that is, the valve 19 should be slowly opened so as to admit air through the conduits 20 and 14 into the sealant storage vessel 6.

During the sealant transfer from the sealant storage vessel 6 to the impregnation vessel 5, air should not enter the impregnation vessel 5.

Desirably, the inner space of the impregnation vessel 5 should be evacuated during the sealant transfer so as to suppress an appreciable pressure increase due to the sealant transfer, thus attaining an excellent sealing property. A preferred pressure in the impregnation vessel 5 to be attained by evacuation is approximately 5 mbar (500 Pa) or less.

The valve 9 is closed when the sealant 7 reaches a predetermined level in the impregnation vessel 5, and the workpieces 8 are immersed in the sealant. Then impregnation is carried out.

The valves 17 and 21 are closed, the valve 16 is opened, and the pressure pump 13 is actuated. Pressure is applied to the sealant 7 through the conduit 15, which opens above the surface level of the sealant within the impregnation vessel 5. Pressure application and the duration of pressure application depend on the kind of workpieces. Usually, a pressure ranging from 5 kg/cm$^2$ (49 MPa) to 10 kg/cm$^2$ (98 MPa) is applied for a period of from 10 minutes to 20 minutes.

Alternatively, the valves 16 and 17 are closed, and the valve 21 is opened so as to communicate the inner space of the impregnation vessel 5 with the ambient air through the conduit 22. Atmospheric pressure is applied to the sealant 7 in the impregnation vessel 5.

It should be noted that since impregnation starts when the workpieces 8 are immersed in the sealant 7, impregnation can be carried out without pressure application. However, impregnation is promoted when pressure is applied to the sealant 7.

After impregnation, the valve 9 is opened and the sealant 7 is transferred from the impregnation vessel 5 to the sealant storage vessel 6 due to a pressure difference between the impregnation vessel 5 and the sealant storage vessel 6. This pressure difference is automatically created since a pressure of usually from 5 kg/cm$^2$ (49 MPa) to 10 kg/cm$^2$ (98 MPa) is applied to the sealant 7 and since the pressure in the sealant storage vessel 6 is usually very low.

Desirably, at least one of the valves 17 and 18 is opened and the vacuum pump 12 is activated to control the pressure difference, thereby causing a calm flow of the sealant 7. Such control is necessary if, for example, the inner space of the sealant storage vessel 6 is exposed to atmospheric pressure and the inner space of the sealant storage vessel 6 has a pressure of from 5 kg/cm$^2$ to 10 kg/cm$^2$ (49 ~ 98 MPa) since under such a great difference in pressure the sealant flow from the impregnation vessel 5 into the sealant storage vessel 6 becomes turbulent, with the result that air tends to be dragged into the sealant 7. In order to control the pressure difference and thus create a calm flow of the sealant 7, actuation of the pressure pump 13 is stopped, the valve 16 is closed, and the valve 21 is opened so as to introduce ambient air into the impregnation vessel 5 through the conduit 22, thereby decreasing the pressure in the impregnation vessel 5 to, for example, 2 kg/cm$^2$ (19 MPa), that is, creating a pressure difference of 1 kg/cm$^2$ (9.8 MPa). After such a pressure difference is attained, the valve 9 is opened.

In order for the sealant 7 which is not used for impregnation to be thoroughly transferred back into the sealant storage vessel 6 and, further, to prevent air from being dragged into the sealant 7, a pressure which is not very high should be applied to the sealant 7 after the sealant level is lowered to below the workpieces 8. The pressure applied to the workpieces 8 expels the sealant 7 which is retained within the holes or recesses of the workpieces 8. The expelled sealant 7 is completely transferred back into the sealant storage vessel 6 due to the pressure applied to the sealant 7.

Following the complete transfer of the sealant 7 from the impregnation vessel 5 into the sealant storage vessel 6, the cover of the impregnation vessel 5 is removed and the workpieces 8 are withdrawn from the impregnation vessel 5 and are rinsed. The sealant 7, which fills the cast defects, is then heated so as to cure it, in the case of an organic sealant, or to vitrify it, in the case of a water glass sealant.

When the impregnation is repeated by using the identical sealant 7, the above described steps except for the sealant admitting step are further carried out.

In the impregnation described above, a pressure-detecting means, such as a pressure sensor or gauge, may be attached, if desired, to one of or both of the vessels 5 and 6 above the sealant level, or in one of or both of the conduits 14 and 15. However, the pressure of the vessels 5 and 6 can be determined, without the attachement of such a pressure-detecting means, on the basis of the operation time of the first and second pressure-controlling means.

Figure 2:
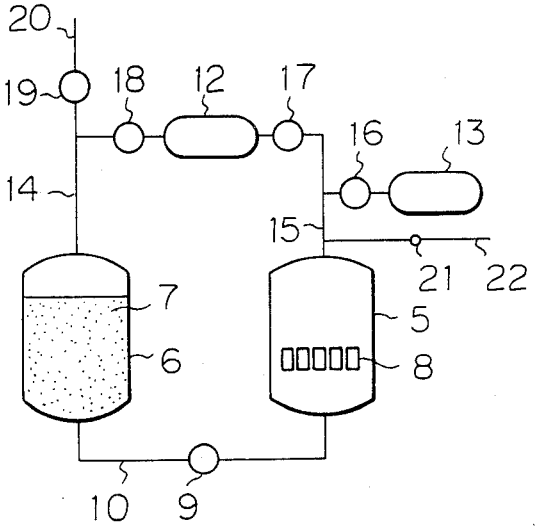
FIGS. 2 and 3 are schematic drawings of preferred impregnation apparatuses according to the present invention.
Figure 3:
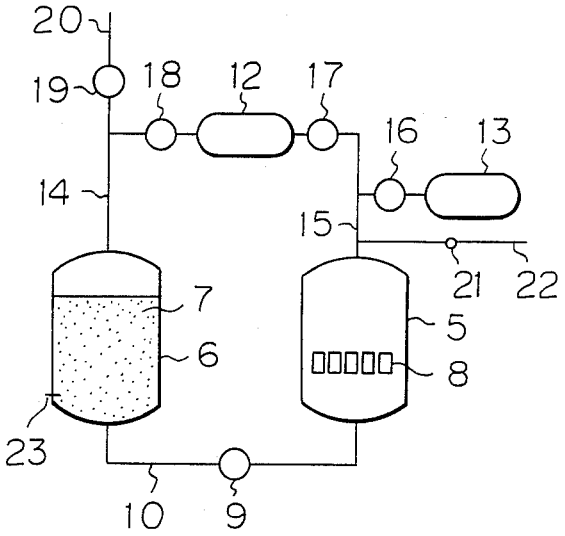

In FIG. 3, another preferred embodiment of the apparatus according to the present invention is illustrated. This apparatus comprises the same members as in FIG. 2 and additionally comprises a means for detecting the sealant level. This means is denoted by 23 and enables the final level of the sealant 7 within the sealant storage vessel 6 to be controlled, i.e., the sealant level within the sealant storage vessel 6 before the initiation of impregnation. The sealant level-detecting means 23, which may be a float means, a pressure sensor, or any other conventional means, is located preferably in a lower portion of the sealant storage vessel 6 so that a substantial amount of the sealant 7 can be used for impregnation.

The apparatus illustrated in FIG. 3 is operated basically in the same manner as that described with reference to FIG. 2.

The first and second pressure-controlling means (12 to 18 and 22) are operated so as to make the pressure of the two vessels 5 and 6 substantially equal, so as to prevent formation of a turbluent flow during the first flowing period (described later). The first and second pressure-controlling means are operated during the second flowing period (described later) so as to realize a calm sealant flow from the sealant storage vessel 6 to the impregnation vessel 5. During the first flowing period, the sealant 7 can flow from the sealant storage vessel 6 to the impregnation vessel 5 due to its potential head. During the second flowing period where the sealant 7 cannot flow due to its potential head, a pressure must be applied to the sealant 7 in order to transfer it from the sealant storage vessel 6 to the impregnation vessel 5. Such pressure is very liable to cause air to be dragged into the sealant 7. Also during the second flowing period, the pressure difference between the two vessels 5 and 6 should be appropriately controlled by means of the first and second pressure-controlling means. Since the impregnation vessel 5 is usually evacuated to create a vacuum prior to feeding the sealant 7 thereinto, the pressure of the sealant storage vessel 6 is controlled so that it is substantially greater than the vacuum but less than the pressure at which a turbluent flow of the sealant results. The sealant 7 is preferably returned from the impregnation vessel 5 to the sealant storage vessel 6 due to atmospheric pressure of the impregnation vessel 5, without any change of the pressure of the sealant storage vessel 6. This return of the sealant 7 can be accomplished simply by opening the valves 9 and 21. In this case, the pressure of the sealant storage vessel 6 is preferably approximately 0.5 atm (approximately 5 MPa) during the second flowing period. Such pressure can be substantially maintained during the impregnation and sealant-reflowing steps, and, therefore, the sealant 7 can be returned by opening the valves 9 and 21 and thus applying atmospheric pressure to the sealant 7 in the impregnation vessel 5.

In addition, the valve 9 is closed when the workpieces 8 are immersed in the sealant 7 and the sealant level in the sealant storage vessel 6 is at a predetermined level. Specifically, when the valve 9 is opened, the sealant 7 starts to flow from the sealant storage vessel 6 into the impregnation vessel 5 via the channel 10. Such flow is stopped by closing the valve 9, which is operably connected to the sealant level-detecting means 23 when the means 23 detects a predetermined low level of the sealant 7, at which level a calm sealant flow is realized without air being dragged into the sealant 7. The sealant level-detecting means 23 is desirably positioned in the lower portion of the sealant storage vessel 6 so that the sealant 7 always fills at least the channel 10.

The impregnation vessel 5 may be provided with a similar sealant level-detecting means (not shown) which controls the sealant reflowing from the impregnation vessel 5 to the sealant storage vessel 6.

According to the present invention, the fraction defective of pressure-proof and gas-tight articles can be reduced to approximately one third the conventional one. In tests carried out by the present inventors to impregnate 336 housings of swash plate-type compressors, the housings were treated once according to the method of the present invention and were subjected three times to a gas proof test, during which test an inner pressure of 22.5 kg/cm$^2$ (220 MPa) was applied by nitrogen gas for a period of 30 seconds. The fraction defective was 2.7%. Contrary to this, the fraction defective according to the prior art method illustrated in FIG. 1 was 7.8% when impregnation was repeated twice.

We claim:

1. A method for impregnating a die-cast article with a sealant, comprising the steps of:

preparing an impregnation vessel equipped with a first means for controlling the pressure therein, said means including a conduit and a pump;

preparing a sealant storage vessel equipped with a second means for controlling the pressure therein and being communicated with said impregnation vessel via a channel equipped with a valve;

locating said die-cast article within said impregnation vessel;

admitting said sealant into said sealant storage vessel while closing said valve of the channel;

operating said first pressure-controlling means so as to evacuate the air contained in said impregnation vessel and so as to degas the air contained in the cast defects of said die-cast article while said valve of the channel is closed;

operating said second pressure-controlling means so as to evacuate the air contained in said sealant storage vessel into which said sealant is admitted while said valve of the channel is closed;

while said valve of the channel is closed, operating at least one of said first and second pressure-controlling means so as to adjust the pressure in said impregnation vessel and the pressure in said sealant storage vessel to substantially the same level;

opening said valve, thereby permitting said sealant to flow solely by gravity from said sealant storage vessel into said impregnation vessel through said channel;

closing said valve of the channel so as to stop said flow of the sealant when said die-cast article is immersed in said sealant;

impregnating said sealant into said die-cast body;

creating a pressure difference between said sealant storage vessel and said impregnation vessel, said pressure difference being created, after said valve-opening step for the sealant to flow and, at the latest, before completion of the subsequent valve-opening and reflowing step; and opening said valve of the channel and reflowing said sealant from said impregnation vessel into said sealant storage vessel through said channel, said reflowing being carried out essentially due to said pressure difference.

2. A method according to claim 1, said pressure-difference creating step comprising a step of applying pressure to the bath surface of said sealant in said impregnation vessel.

3. A method according to claim 2, wherein said pressure-applying step is carried out before or simultaneous with said impregnating step.

4. A method according to claim 3, wherein said applied pressure is essentially maintained during said valve-opening and reflowing step.

5. A method according to claim 1, wherein said impregnating step is carried out under a pressure which is attained at the end of said valve-closing step to stop the sealant flow and said pressure-difference creating step is carried out after said impregnating step.

6. A method according to claim 5, wherein said pressure-difference creating step comprises a step of applying pressure to the bath surface of said sealant in said impregnation vessel before said valve-opening and reflowing step and said applied pressure is essentially maintained during said valve-opening and reflowing step.

7. A method according to claim 1, further comprising, after or during said valve-opening and reflowing step, a step of operating at least one of said first and second pressure-controlling means so as to control the pressure difference so as to create a calm reflow of the sealant.

8. A method according to claim 1, further comprising, after said valve-opening step for permitting the sealant to flow solely by gravity and said valve-closing step for stopping the sealant from flowing, a step of applying atmospheric pressure to the surface level of the sealant contained in said sealant storage vessel when said surface level is lowered to substantially the same level as that of the sealant contained in said impregnation vessel.

9. A method according to claim 1, wherein said pressure-difference creating step includes operating said first pressure-controlling means to apply at least atmospheric pressure.

10. A process according to claim 1, wherein further comprising the entire steps except for the vessel preparing steps and the sealant admitting step to repeat the impregnation using the identical sealant.

11. A method for impregnating a die-cast article with a sealant, comprising the steps of:

preparing an impregnation vessel equipped with a first means for controlling the pressure therein, said means including a conduit and a pump;

preparing a sealant storage vessel equipped with a second means for controlling the pressure therein and being communicated with said impregnation vessel via a channel equipped with a valve;

locating said die-cast article within said impregnation vessel;

admitting said sealant into said sealant storage vessel while closing said valve of the channel;

operating said first pressure-controlling means so as to evacuate the air contained in said impregnation vessel and so as to degas the air contained in the cast defects of said die-cast article while said valve of the channel is closed;

operating said second pressure-controlling means so as to evacuate the air contained in said sealant storage vessel into which said sealant is admitted while said valve of the channel is closed;

while said valve is closed, operating at least one of said first and second pressure-controlling means so as to adjust the pressure in said impregnation vessel and the pressure in said sealant storage vessel to substantially the same level;

opening said valve of the channel, thereby permitting said sealant to flow solely by gravity from said sealant storage vessel into said impregnation vessel through said channel;

closing said valve of the channel so as to stop said flow of the sealant when said die-cast article is immersed in said sealant;

after said valve-opening step for permitting the sealant to flow and said valve-closing step for stopping the sealant from flowing, applying at least atmospheric pressure to the surface level of the sealant contained in said sealant storage vessel, said surface level being substantially the same as that of the sealant contained in said impregnation vessel;

impregnating said die-cast article with said sealant and applying pressure to said sealant simultaneous with said impregnating step, thereby creating a pressure difference between said sealant storage vessel and said impregnation vessel;

opening said valve and reflowing said sealant from said impregnation vessel into said sealant storage vessel through said channel under said pressure difference; and, after or during said valve-opening and reflowing step, operating at least one of said first and second pressure-controlling means so as to control the pressure difference so as to create a calm reflow of the sealant.

12. A method according to claim 1, further comprising installing the sealant storage vessel and the impregnation vessel at the same level.

13. An apparatus for impregnating a die-cast article with a sealant according to the present invention comprises:

a gas- and liquid-tight impregnation vessel;

a gas- and liquid-tight sealant storage vessel;

a channel communicating said impregnation vessel and said sealant storage vessel;

a valve for closing said channel at the impregnation, and at evacuation of air contained in said impregnation vessel and sealant storage vessel, and for opening said channel during sealant flow through the channel;

a first means including a conduit and a pump for evacuating air contained in said impregnation vessel so as to degas the air contained in the cast defects of said die-cast article while said valve of the channel is closed; and, a second pressure-controlling means for evacuating air contained in said sealant storage vessel into which said sealant is admitted while said valve of the channel is closed.

14. An apparatus according to claim 13, wherein said sealant storage vessel and said impregnation vessel are installed at substantially the same level.

15. An apparatus according to claim 13, wherein said first pressure-controlling means comprises a conduit, a valve, and a vacuum pump and, further, said second pressure-controlling means comprises a conduit, a valve, and a vacuum pump and, further, said second pressure-controlling means comprises a conduit, a valve, and a vacuum pump, said vacuum pump of the first pressure-controlling means and said vacuum pump of the second pressure-controlling means being the same vacuum pump.

16. An apparatus according to claim 13, wherein said second pressure-controlling means comprises a conduit equipped with a valve and a vacuum pump and a branch conduit branched from said conduit and equipped with a valve and a pressure pump.

17. An apparatus according to claim 13, wherein said second pressure-controlling means comprises a conduit equipped with a valve and a vacuum pump, a first branch conduit branched from said conduit and equipped with a valve and a pressure pump, and a second branch conduit branched from said conduit, equipped with a valve, and communicating with the ambient air.

18. An apparatus according to claim 13, further comprising a means for detecting the sealant level in the sealant storage vessel, said means being operably connected to the closable valve and being positioned in the sealant storage vessel in such a manner that it can detect the sealant level when a substantial amount of the sealant is caused to flow into the impregnation vessel.

* * * * *